US006494246B1

(12) United States Patent
Blevins

(10) Patent No.: US 6,494,246 B1
(45) Date of Patent: Dec. 17, 2002

(54) RETRACTABLE AWNING AND METHOD

(76) Inventor: Timothy D. Blevins, P.O. Box 310, DeKalb, TX (US) 75559

( * ) Notice: Subject to any disclaimer, the term of this patent is extended or adjusted under 35 U.S.C. 154(b) by 0 days.

(21) Appl. No.: 09/366,629

(22) Filed: Aug. 2, 1999

Related U.S. Application Data

(60) Provisional application No. 60/095,047, filed on Aug. 3, 1998.

(51) Int. Cl.[7] ..... E04F 10/06

(52) U.S. Cl. ..... 160/67; 52/74; 135/88.12

(58) Field of Search ..... 52/74, 73; 160/67, 160/66, 79, 45, 69; 135/88.12, 88.11

(56) References Cited

U.S. PATENT DOCUMENTS

| | | | | |
|---|---|---|---|---|
| 1,882,425 | A | | 10/1932 | Kasan |
| 3,226,066 | A | | 12/1965 | Folb ..... 248/40 |
| 3,324,869 | A | | 6/1967 | Duda ..... 135/5 |
| 3,356,329 | A | | 12/1967 | Santo ..... 248/273 |
| 3,612,145 | A | | 10/1971 | Darula et al. ..... 160/67 |
| 3,834,400 | A | | 9/1974 | Sattler ..... 131/5 |
| 3,918,510 | A | | 11/1975 | Hayward ..... 160/45 |
| 3,980,121 | A | | 9/1976 | McKee ..... 160/71 |
| 3,991,805 | A | | 11/1976 | Clauss |
| 4,075,723 | A | | 2/1978 | Bareis et al. ..... 9/1.5 |
| 4,171,013 | A | | 10/1979 | Clark ..... 160/22 |
| 4,214,621 | A | * | 7/1980 | Wessells et al. |
| 4,495,977 | A | * | 1/1985 | Delluc |
| 4,640,332 | A | | 2/1987 | Turner ..... 160/46 |
| 4,719,954 | A | | 1/1988 | Curtis et al. ..... 160/57 |
| 4,770,223 | A | | 9/1988 | Ouellette |
| 4,801,119 | A | | 1/1989 | Pelletier ..... 248/354.5 |
| 5,026,109 | A | | 6/1991 | Merlot, Jr. ..... 296/105 |
| 5,094,285 | A | | 3/1992 | Murray ..... 160/67 |
| 5,148,849 | A | | 9/1992 | Faludy |
| 5,174,352 | A | * | 12/1992 | Murray et al. ..... 160/69 X |
| 5,203,393 | A | | 4/1993 | Blevins et al. ..... 160/67 |
| 5,207,255 | A | | 5/1993 | Shannon ..... 160/65 |
| 5,232,036 | A | * | 8/1993 | Brutsaert |
| 5,253,667 | A | | 10/1993 | Chung ..... 135/103 |
| 5,369,919 | A | * | 12/1994 | Lohausen ..... 52/73 |
| 5,449,032 | A | | 9/1995 | Blevins et al. ..... 160/80 |
| 5,622,214 | A | | 4/1997 | Baka et al. ..... 160/71 |
| 5,752,556 | A | | 5/1998 | Steadman |
| 5,848,629 | A | | 12/1998 | Baka |
| 5,921,305 | A | * | 7/1999 | Grudl |
| 5,944,985 | A | | 8/1999 | Malott |
| 6,000,501 | A | * | 12/1999 | Evans ..... 135/88.12 X |
| 6,006,810 | A | | 12/1999 | Malott |
| 6,021,836 | A | * | 2/2000 | Schmitz ..... 160/79 X |
| 6,089,306 | A | | 7/2000 | Frey, Jr. |
| 6,098,693 | A | * | 8/2000 | Frey, Jr. |
| 6,125,905 | A | * | 10/2000 | Woodside et al. |

FOREIGN PATENT DOCUMENTS

| | | |
|---|---|---|
| GB | 298363 | 10/1928 |

* cited by examiner

*Primary Examiner*—Jose V. Chen
(74) *Attorney, Agent, or Firm*—Robert J. Ward; J. Robert Brown, Jr.; Hunton & Williams

(57) ABSTRACT

An exemplary retractable awning and method are provided for mounting to virtually any structure, such as a house trailer, recreational vehicle, house, patio, deck, and the like, to provide shade and protection from the elements. The retractable awing includes a roller tube assembly, a covering, and support arms. The roller tube assembly includes a roller tube and at least one retractable rib. The roller tube has a first end, a second end, and a rib storage groove operable to receive and store the retractable rib so that the retractable rib may couple with the roller tube and extend from a retracted position, at least partially within the rib storage groove, to an extended position. The retractable rib may have an upward arch or bend when in its extended position. The covering couples between the structure and the roller tube assembly and may be supported by the retractable rib when open. The covering provides shade and protection from the elements when open. The support arms couple between the first and second end of the roller tube, respectively, and the support. A method for manufacturing or assembling a retractable awning is also provided.

10 Claims, 10 Drawing Sheets

FIG. 13
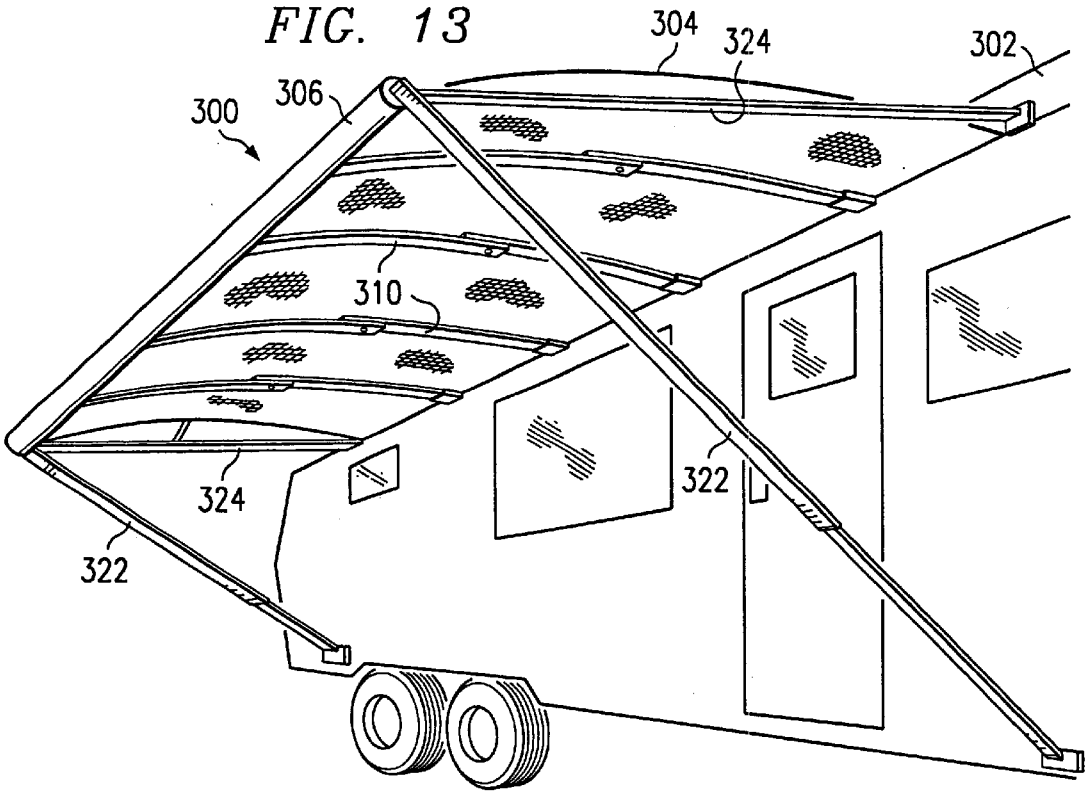
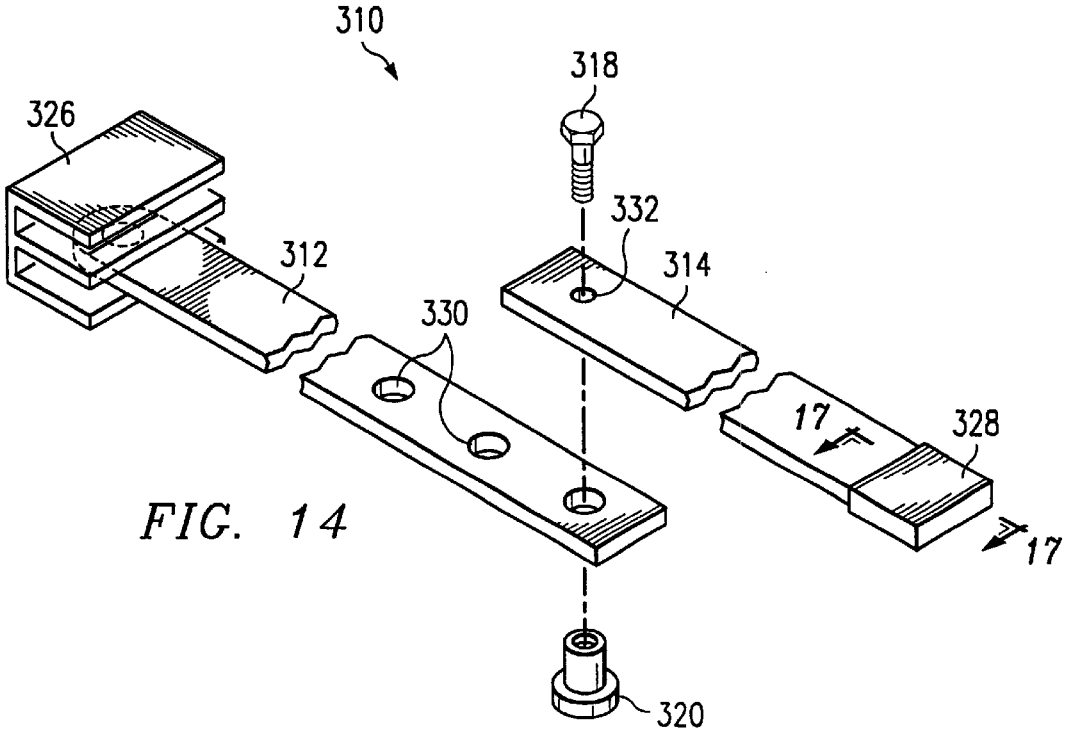
FIG. 14

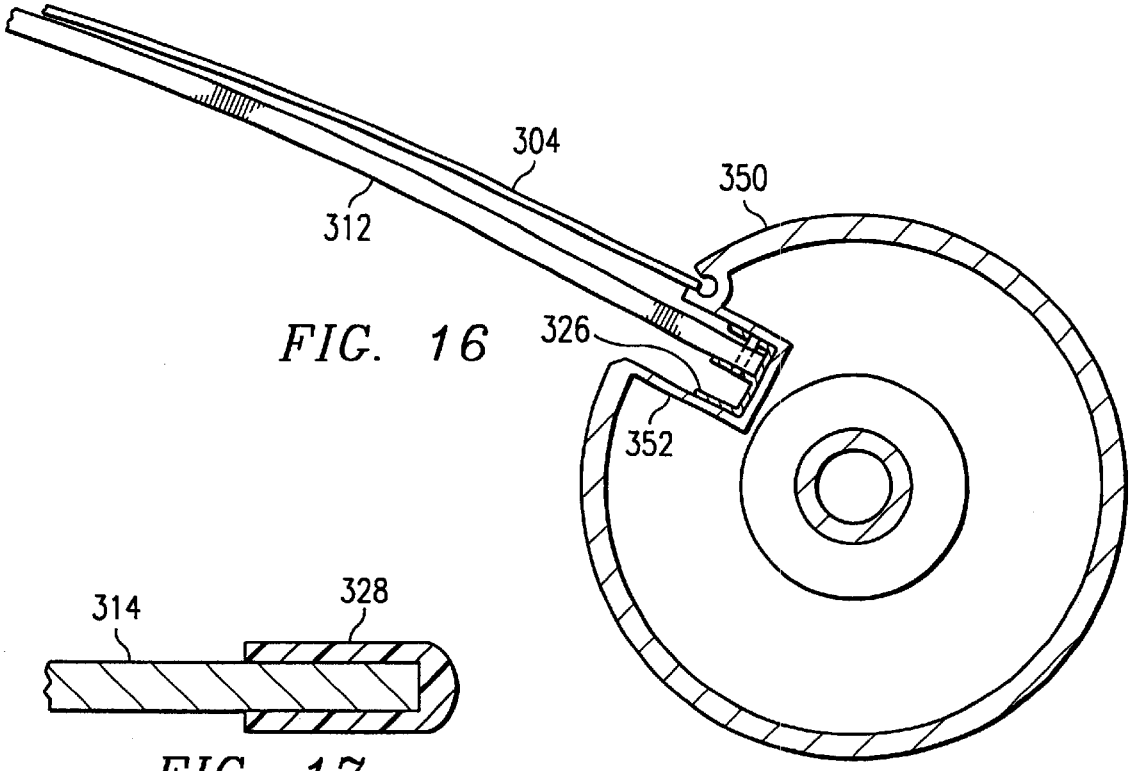
FIG. 16
FIG. 17
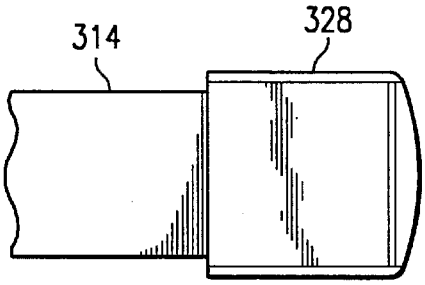
FIG. 18
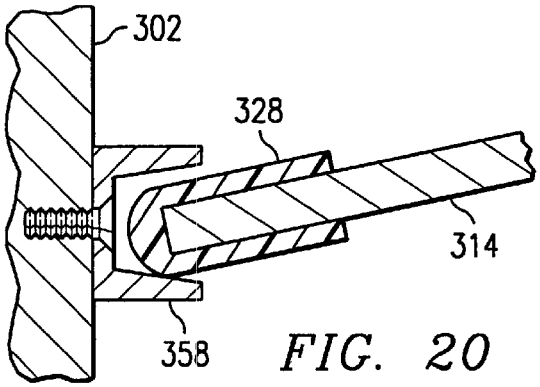
FIG. 20
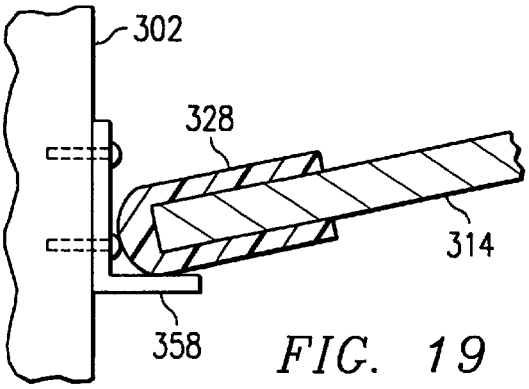
FIG. 19
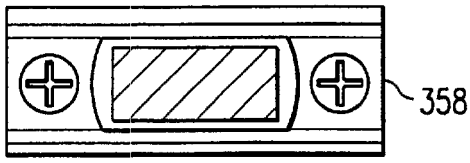
FIG. 21

RETRACTABLE AWNING AND METHOD

CLAIM OF PRIORITY

This application claims priority from, and incorporates herein by reference for all purposes, U.S. provisional patent application Ser. No. 60/095,047, entitled Hinged Awning-Support Ribs by Timothy D. Blevins as inventor and filed on Aug. 3, 1998.

TECHNICAL FIELD OF THE INVENTION

This invention relates in general to the field of awnings and more particularly to a retractable awning and method.

BACKGROUND OF THE INVENTION

Awnings provide much needed protection from the weather and elements and are commonly found on many structures and vehicles such as house trailers, recreational vehicles ("RVs"), porches, patios, and decks. The protection that an awning provides, such as shade and protection from rain and wind, greatly enhances the overall enjoyment of such structures and vehicles by substantially increasing the comfort of the surrounding environment across a wide range of weather conditions and elements. Awnings significantly increase the amount of time that such structures and vehicles may be used and enjoyed.

Awnings that can be extended for use and retracted for storage are especially useful for house trailers and RV's where the awning needs to be stored before the vehicles moves. Various designs for such stow-away awnings have been created that will fit on the side of a house trailer, RV, or virtually any other structure to provide cover when opened, and also store compactly and securely when retracted. The most common design uses a roller tube around which the awning is wrapped when not in use. Typical designs are shown in U.S. Pat. No. 3,918,510, issued to Hayward, and U.S. Pat. No. 3,980,121, issued to McKee.

A problem with these designs results from the absence of medial struts or rafters, which might interfere with the process of rolling the awning on the roller tube. Roller tubes tend to be rather long, and if the tube bends, the awning may sag, forming pockets for the collection of puddles of rain water, or which may flap and be buffeted by winds, causing noise and accelerated fabric wear.

The present inventor has previously addressed these problems in his prior U.S. Pat. No. 5,203,393 (the '393 patent) and U.S. Pat. No. 5,449,032 (the '032 patent), which are hereby incorporated by reference. The '393 patent teaches a plurality of bowed ribs extending transversely between the roller tube and the wall of the trailer or RV, stretching and supporting the awning and imparting a slight arch to the awning. The '032 patent is similar, but whereas the adjustable ribs of the '393 patent are flexible ribs bowed by compression, the '032 patent teaches adjustable ribs made from rigid, curved elements used with a rigid, bowed housing.

Although the adjustable, bowed ribs of the '393 and '032 patents represent an advance in the art, problems with convenience in use of awnings and storage of awnings are still present. As currently known in the art, the adjustable ribs must be removed from their supports underneath the awning and stored separately, usually at a location inside the trailer or RV selected by the user. Since storage space in house trailers and RVs is usually at a premium, it often proves difficult to find a storage location, or it may prove unduly burdensome or inconvenient to have to enter and re-enter the house trailer or RV to remove the ribs from storage for use and replace them in storage after use.

Thus, although awnings that can be extended for use and retracted for storage are especially beneficial and provide many significant advantages, these awnings still suffer from certain problems and inconveniences. Many awnings are difficult and cumbersome to setup and assemble, and even more troublesome to take down and store. As mentioned above storage of awning parts and components when an awning is retracted and not in use can be problematic. For example, removable awning ribs or bows must be taken down and stored separately when the awning is retracted and in a stored state. In addition to the obvious problems of not being able to keep track of the various awning parts and components, storage of such parts and components can be especially troubling. For example, removable awning ribs or bows are often long, fragile, and hard to store. This is especially problematic on RV's where storage space is especially limited.

Other attempts to address this problem are disclosed in U.S. Pat. No. 5,622,214, issued Apr. 22, 1997 to Baka, et al., and U.S. Pat. No. 5,174,352, issued Dec. 29, 1992 to Murray, et al. The Baka patent describes a roller tube rotatably attached to the wall of the trailer and a lead rail extending from the wall and supported by support arms, the lead rail extending the awning and a pair of telescoping rafters pivotally mounted to the wall. Among other design limitations, the rafters in the Baka patent are not arched or bowed and are not hinged or pivotally connected at the middle of the rafter.

The Murray patent describes a roller tube extending from the wall of the trailer to extend the awning, having a single rafter which has two sections pivotally connected and which is stored in a recess in the roller tube. In addition to other design limitations, the rafter in the Murray patent, however, is not bowed or arched, but substantially straight. The rafter is not pivotally connected to the roller tube, but has a cylindrical anchor slidable in the recess and a pin at the end of the rafter that must be inserted in a bore defined in the cylindrical anchor using a washer. The rafter is, apparently, not collapsed for storage in the roller tube, but is fully extended, as the rafter includes a gas spring at the opposite end, which attaches to a bracket by means of a notch in the end of the rafter which mates with a bar on the brackets, the gas spring extending to straighten the rafter and lock the pivotally connected ends of the rafter. Finally, there is only one rafter, which is not sufficient to support awnings having a length of sixteen to twenty four feet.

None of the above inventions and patents, taken either singly or in combination, describes, teaches, or suggests the instant invention as claimed.

SUMMARY OF THE INVENTION

From the foregoing it may be appreciated that a need has arisen for a retractable awning and method that provides an awning with retractable ribs or support members that can be easily, conveniently, and quickly setup and assembled and taken down without the need to separately store the retractable ribs. In accordance with the present invention, a retractable awning and method are provided that substantially eliminate one or more of the disadvantages and problems outlined above.

According to one aspect of the present invention, a retractable awning is provided that may be mounted to a structure, such as a house trailer, recreational vehicle, house, porch, patio, building, house and the like to provide shade and protection from the elements. The retractable awning includes a roller tube assembly, a covering, and support arms.

The roller tube assembly includes a roller tube and a retractable rib. The roller tube has a first end, a second end, and a rib storage groove operable to receive and store the retractable rib so that the retractable rib may couple with the roller tube and extend from a retracted position, at least partially within the rib storage groove, to an extended position. The retractable rib may have an upward arch or bend when in its extended position. Because the retractable rib can be stored in the rib storage groove, it need not be stored separately from the retractable awning when the awning is in a retracted or stored position.

The covering couples between the structure and the roller tube assembly and may be supported by the retractable rib when open. The support arms couple between the first and second end of the roller tube, respectively, and the support.

According to another aspect of the present invention, a method for manufacturing or assembling a retractable awning is also provided.

The present invention provides a profusion of technical advantages that include the capability to easily, conveniently, and quickly setup, assemble, and taken down the retractable awning without the need to separately store the retractable ribs. This eliminates the frustration of lost ribs and saves much needed storage room, especially in vehicles such as RVs.

Another technical advantage of the present invention includes the capability to easily retract or close the awning for storage. Stored rotational or potential energy will allow virtually anyone, regardless of size or strength, to transition the retractable awning from an extended or open position to a retracted or closed position.

The present invention also provides the significant technical advantage of conveniently providing lighting, such as string lights or rope lighting that do not present a safety hazard like outdoor lanterns and lights. These lights do not have to be unplugged and setup and remain with the retractable awning when it is both retracted or stored and when it is extended or open.

Yet another technical advantage of the present invention includes the capability to include not only a rib storage groove or channel in a roller tube, but also a covering mounting groove, a lighting mounting groove, and an auxiliary mounting groove. The auxiliary mounting groove allows a material to be draped from the roller tube and allows a string or rope to be rolled with the covering when retracted or stored to allow for easy opening of the retractable awning using the string or rope.

Still yet another technical advantage of the present invention includes the capability to include support arms that each include an arm and a side rafter that store flat, thus increasing overall convenience and safety. The side rafter may position within an opening, channel, or area formed in the back of the arm when the retractable awning is in a stored or retracted position. This flat storage significantly increases safety by reducing the chance of accidently bumping into the stored awning.

Yet another technical advantage of the present invention includes arched or bowed retractable ribs that provide an arched support to the covering prevent the covering from sagging. This prevents water and other substances from pooling on the upper surface of the covering.

Another technical advantage of the present invention includes retractable ribs that are adjustable in length. This allows for the arched support provided to the covering to be varied as desired and allows for the accommodation of awnings of different sizes and to allow the covering to be opened or extended partially or not to its full extent.

Other technical advantages are readily apparent to one skilled in the art from the following figures, description, and claims.

BRIEF DESCRIPTION OF THE DRAWINGS

For a more complete understanding of the present invention and the advantages thereof, reference is now made to the following brief description, taken in connection with the accompanying drawings and detailed description, wherein like reference numerals represent like parts, in which:

FIG. 13 is a perspective view that illustrates a retractable awning in an extended position according to another embodiment of the present invention;

FIG. 14 is a cutaway, exploded perspective view that illustrates an alternative retractable rib, a hinged rib;

FIG. 16 is a side, section view along the line 16—16 of FIG. 15 that illustrates the use of the rib storage groove and the covering mounting groove of the roller tube when the retractable awning is in the extended position according to an alternative embodiment of the present invention;

FIG. 17 is a partial, side, section view along the line 17—17 of FIG. 14 that illustrates the tip of the retractable rib;

FIG. 18 is a partial, perspective view that illustrates the tip of the retractable rib of FIG. 17;

FIG. 19 is a partial, side, cutaway view that illustrates the interface of the tip of the retractable rib and the hanger, according to one embodiment of the present invention;

FIG. 20 is a partial, side, cutaway view that illustrates the interface of the tip of the retractable rib and another hanger; and FIG. 21 is a front view that illustrates an alternative hanger with a protective socket layer.

DETAILED DESCRIPTION OF THE INVENTION

It should be understood at the outset that although an exemplary implementation of the present invention is illustrated below, the present invention may be implemented using any number of techniques, whether currently known or in existence. The present invention should in no way be limited to the exemplary implementations, drawings, and techniques illustrated below, including the exemplary design and implementation illustrated and described herein.

Figure 1:
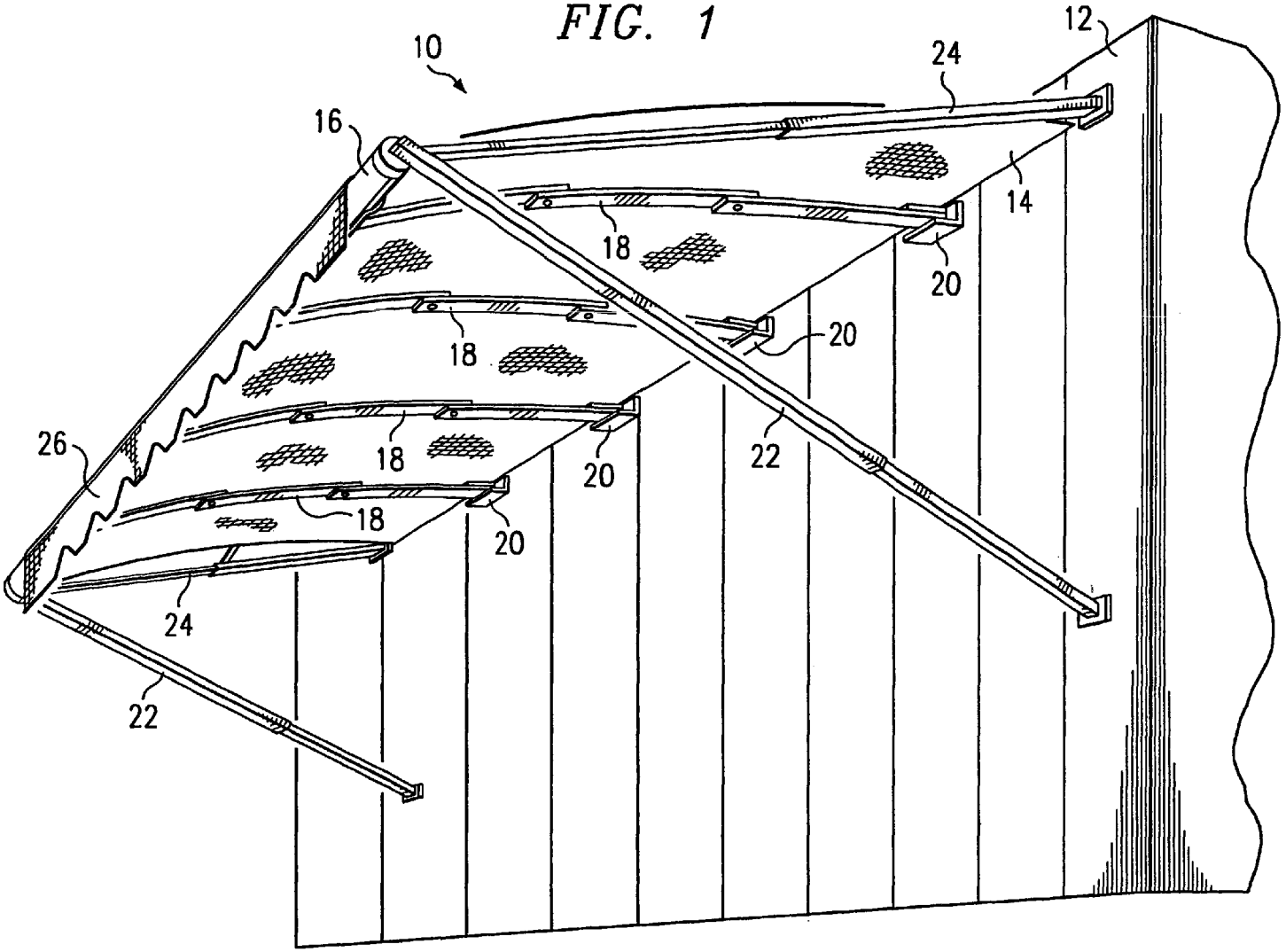
FIG. 1 is a perspective view that illustrates a retractable awning in an extended position according to an embodiment of the present invention.

FIG. 1 is a perspective view that illustrates a retractable awning 10 in an extended position according to an embodiment of the present invention. The retractable awning 10 is attached or mounted to a structure 12. The retractable awning 10 includes a covering 14 that generally spans from the structure 12 to a roller tube assembly 16. A plurality of retractable ribs 18 provide additional support to the covering 14. In a preferred embodiment, the plurality of retractable ribs 18 are slightly bowed or arched upwardly to provide upward support to the covering 14 and to provide a rounded or curved shape to the covering 14. This provides several advantages, one of which is to prevent any pooling of rain or other fluids that may fall on or come in contact with the top of the covering 14.

The plurality of retractable ribs will, preferably, be provided as segments, such as the three segment retractable ribs 18 shown in FIG. 1. The retractable ribs attach, couple, contact, or interface at one end to the roller tube assembly 16 and at the other end to either the structure 12 or to the structure 12 through a hanger 20, or some other intermediate component. Preferably, the retractable ribs 18 will be provided with two or more segments and will have an adjustable length. For example, in one embodiment, the end of the plurality of retractable ribs 18 that contact the hangers 20 may be adjusted so that the length of the retractable ribs can vary depending upon the installation and assembly. This may be achieved in any number of ways, such as by a two piece end arrangement or any other configuration.

The end of the retractable rib 18 that contacts the hanger 20 or the structure 12 may also include a cover, such as a plastic, rubber, or polymer cover. In one embodiment illustrated in FIGS. 17 through 18 and discussed below, only two sides and the far end are covered by a protective covering, such as a rubber coating. This may provide protection to the structure 12, the hanger 20, and the retractable rib 18.

The retractable awning 10 includes both a right and a left arm/side rafter support. The arm/side rafter supports include an arm 22 and a side rafter 24. Both of these members are retractable and are, preferably, manufactured out of an extruded metal, such as aluminum. In other embodiments, these members are manufactured out of composite materials, plastics, or polymers that exhibit desired mechanical and structural properties, such as strength and weight.

The arm 22 couples between the structure 12 and the roller tube assembly 16. In an alternative embodiment, the end of the arm 22 that couples with or is mounted to the structure 12 may be unclipped or unmounted from the structure 12 and moved to a vertical or more vertical position such that this end may be provided in contact with the ground or to an object in contact with the ground. This provides additional vertical support to the retractable awning 10 and can support more varied configurations for installing the retractable awning 10.

The arm 22 preferably rotatably couples to the roller tube assembly 16. This coupling, however, may be provided as virtually any desired coupling such as a hinged or other coupling. The arm 22 is preferably provided as a retractable arm that is adjustable near its middle. In a preferred embodiment, a spring-loaded latch is provided between the upper segment or portion of the arm 22 and the lower segment or portion of the arm 22 such that the lower segment may be slid within the upper segment to adjust the overall length of the arm 22 to a desired length, such as, for example, to an extended position or a retracted position. The spring-loaded latch allows for the desired length to be "locked" into place. In one embodiment, the upper segment of the arm 22 may include predrilled holes such that a spring-loaded pin may be positioned from one hole to the other.

The lower segment of the arm 22 is shown attached or mounted to the structure 12 through a hinge mounting that, as discussed previously, preferably, may be removed or unclipped so that the end of the arm 22 no longer mounts or attaches to the structure 12.

The side rafter 24 is positioned between the roller tube assembly 16 and the structure 12. The side rafter 24, like the arm 22, is retractable. In the preferred embodiment shown in FIG. 1, a portion or segment of the side rafter 24 mounts or is attached to the structure 12 while a second segment or portion of the side rafter 24 couples with the roller tube assembly 16. This coupling may be achieved through a connection or coupling between the side rafter 24 and the arm 22, which couples with the roller tube assembly 16. The relative position between the two segments of the side rafter 24 are preferably maintained using an adjustable knob that provides a friction hold between the two segments or portions. The side rafter 24, just as with the arm 22, is preferably made out of an extruded metal, such as aluminum, but may be made of virtually any suitable material.

The embodiment of the side rafter 24 in FIG. 1 includes a first segment, which couples on one end to the structure 12, and a second segment, which, preferably, slidably couples to a second or upper segment of the arm 22. In this manner, as the retractable awning 10 transitions from an extended position to retracted position, the second segment of the side rafter 24 may slide within the first segment of the side rafter 24, and the second segment of the side rafter 24 may slidably move within an opening, channel, or groove in the arm 22 from a position near the roller tube assembly 16 towards the lower segment of the arm 22 and towards the structure 12. In the preferred embodiment shown in FIG. 1, the first segment of the side rafter 24 attaches, couples, or mounts to the structure 12 through a hinged coupling configuration.

In another embodiment, the edge of the covering 14 closest to the side rafter 24 may be attached through a strap or some other mechanism. This is illustrated by the side rib 24 positioned at the far end of the retractable awning 10 of FIG. 1. This prevents wind flap and other undesirable effects during certain weather conditions.

Each of the plurality of retractable ribs 18 are designed such that they may be retracted, through, in a preferred embodiment, the hinged arrangement between the various segments of each retractable rib 18 and stored within a groove, channel, or opening in a roller tube 30 of the roller tube assembly 16. This provides a quick and convenient storage location and conserves critical storage space such as that needed in vehicles, RVs, house trailers, and the like. In other embodiments, the retractable ribs 18 may include various segments or pieces that are in a telescoping arrangement to one another such that the various segments may telescope in and out from one another, similar to a telescoping radio antenna.

A valance 26 is shown mounted to the roller tube of the roller tube assembly 16 to provide additional protection from the elements and to provide an attractive ornamental design at the front of the roller tube assembly 16 of the retractable awning 10.

The retractable awning 10 provides a durable, sturdy, convenient, and efficient means for providing protection from the elements to significantly improve the environment of the area that is covered by the retractable awning 10. It should be understood that FIG. 1 only illustrates one embodiment of the present invention and that a multitude of alternative arrangements and alternative materials may be provided in or with the present invention. For example, the covering 14 may be made of virtually any material such as canvas, nylon, woven acrylic, plastic, cloth, or virtually any available material that provides some form of protection from the elements. The plurality of hangers 20 may be provided in virtually any configuration such as the "L" configuration shown in FIG. 1, a notched configuration, or in a socket configuration, similar to what is shown in FIGS. 20 and 21. The plurality of hangers 20 may include a soft or cushioning material to protect the interface between the adjustable edge of the plurality of retractable ribs 18 and the structure 12. Alternatively, and as mentioned above, the ends of the plurality of retractable ribs 18 that reside against or near the corresponding one of the plurality of hangers 20 may include a rubber or plastic material to protect this interface. This material may encapsulate the entire end of the retractable ribs 18 or it may encapsulate only a portion of the ends of the plurality of retractable ribs 18. Of course, the structure 12 may be any available structure such as, for example, a vehicle, an RV, a van, a trailer, mobile home, a storage shed, a building, a house, a porch, or a patio.

Figure 2:
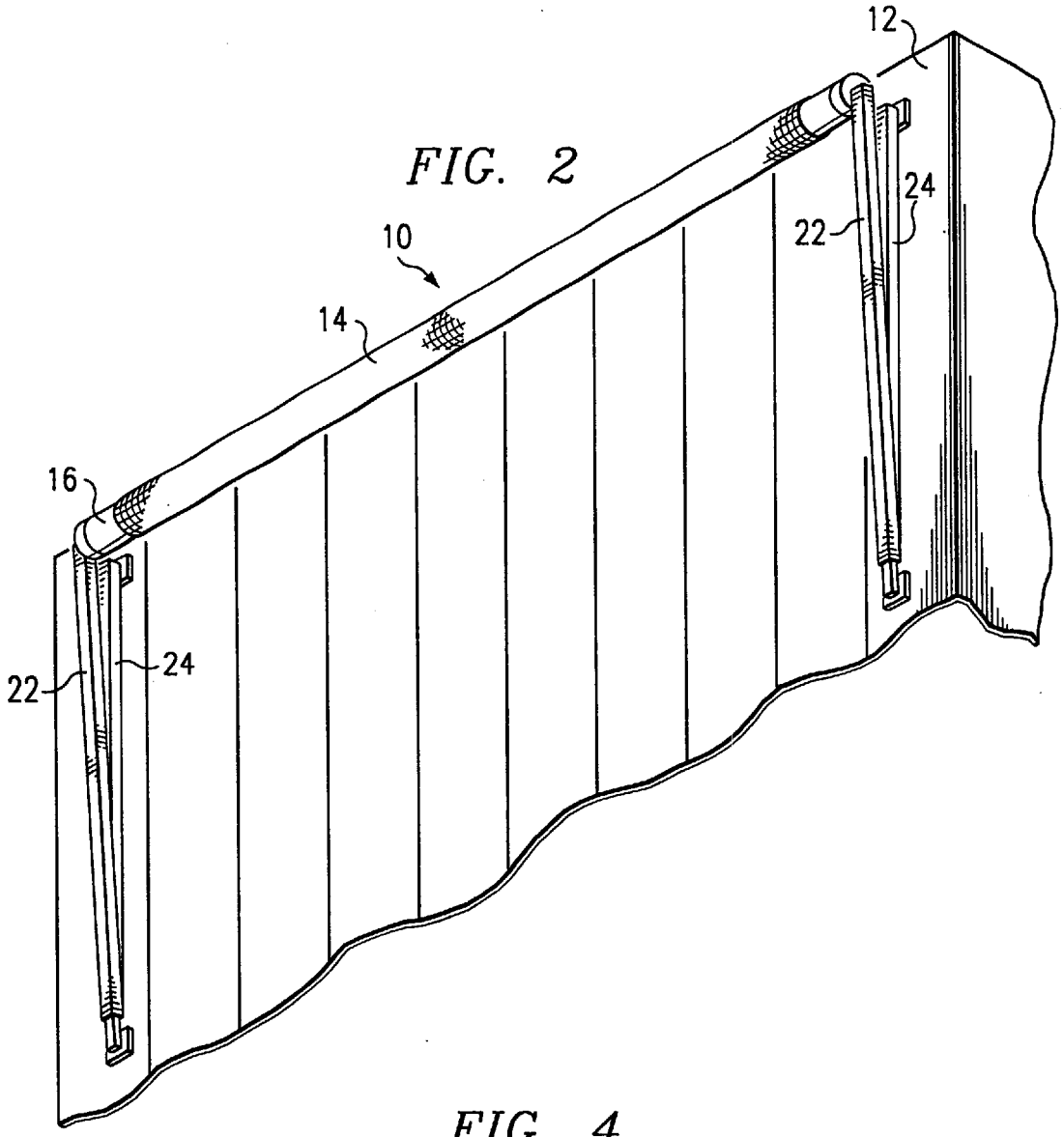
FIG. 2 is a perspective view that illustrates the retractable awning in a closed or stored position.

FIG. 2 is a perspective view that illustrates the retractable awning 10 in a closed or stored position in close proximity and adjacent to the structure 12. This provides a convenient storage location with minimal hindrance to surrounding areas. The covering 14 is shown wound around the roller tube of the roller tube assembly 16. As discussed above, each of the plurality of retractable ribs 18 are stowed or stored within a groove, channel, cavity, or opening within the roller tube of the roller tube assembly 16. This provides significant advantages by ensuring that the retractable ribs 18 are always available and eliminating the need to store pieces or components of the retractable awning 10 separately from the unit.

The relationship between the arm 22 and the side rib 24 is also illustrated in FIG. 2. As can be seen, the lower or first segment of the arm 22 is within the upper or second segment of the arm 22. The second section of the side rib 24 is shown positioned within the side rib 24. The end of the second section of the side rib 24 that was shown in FIG. 1 near the roller bar assembly 16, is now positioned near the point where the lower segment of the arm 22 mounts or attaches to the structure 12. The smaller size of the side rafter 24 also provides the significant advantage of allowing the length of the side rafter 24, as shown in FIG. 2, to fit within an opening or carved-out area or channel of the arm 22. Thus, the position of the retractable awning 10 in FIG. 2 is at a point where it is not quite completely closed because the side rafter 24 is not yet within the opening in the back side of the arm 22. This feature provides even more convenient storage of the retractable awning 10 by ensuring that the unit is tightly positioned next to the structure 12 such that minimal volume of the retractable awning 10 is present. This also serves to significantly reduce the chances of injury and increases overall safety.

Figure 3:
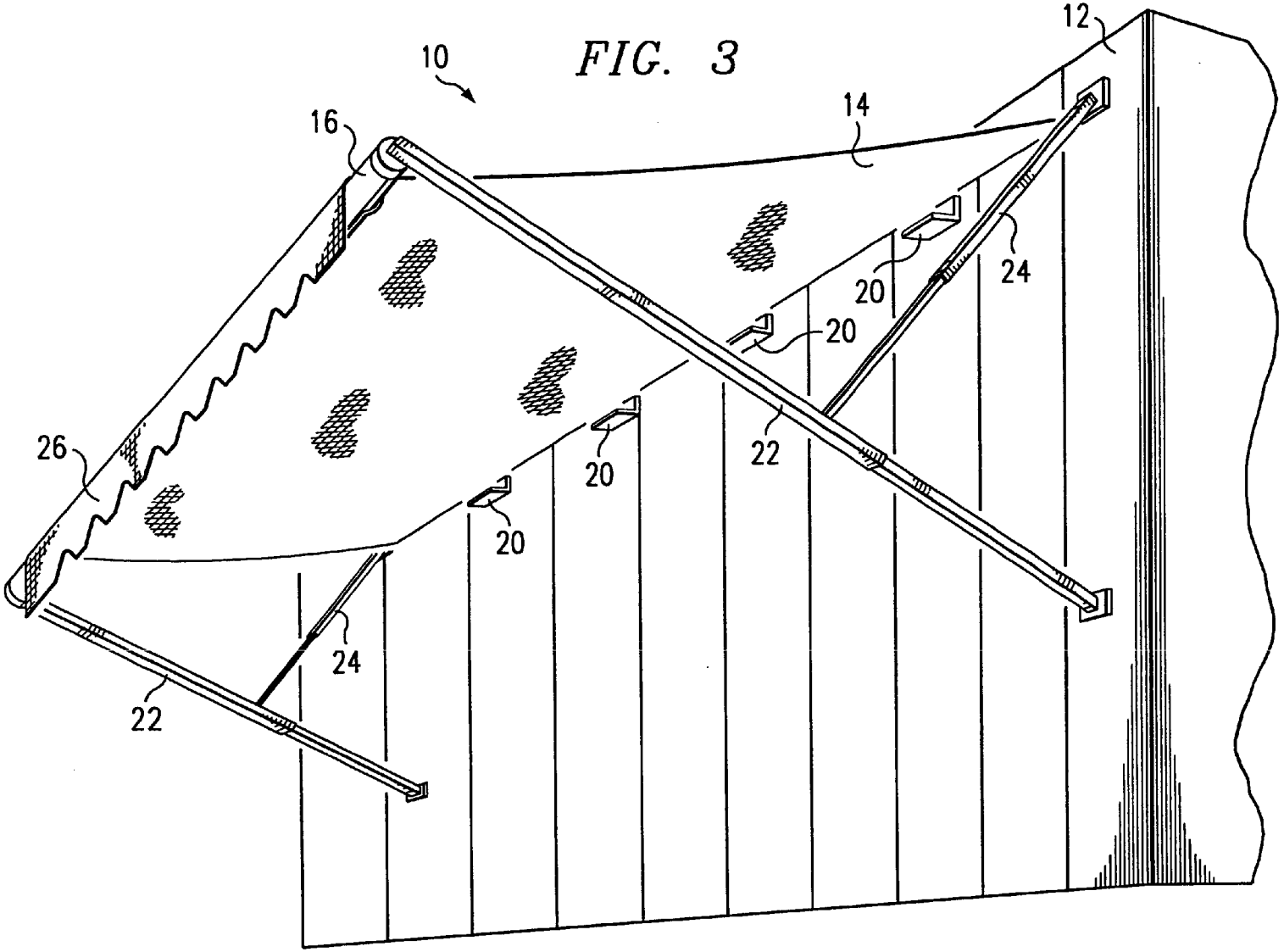
FIG. 3 is a perspective view that illustrates the retractable awning in a partially opened position with the retractable ribs stored in an opening or groove in the roller tube assembly.

FIG. 3 is a perspective view that illustrates the retractable awning 10 in a partially opened (or partially closed) position with the plurality of retractable ribs 18 stored in an opening, channel, cavity, or groove in the roller tube assembly 16. FIG. 3 is similar to FIG. 1 except that the end of the second segment of the side rafters 24 is not slidably positioned near the coupling of the arm 22 and the roller tube assembly 16, and the plurality of retractable ribs 18 are retracted and stored within the opening, cavity, or groove, hereinafter referred to as the rib storage groove, of the roller tube assembly 16.

Figure 4:
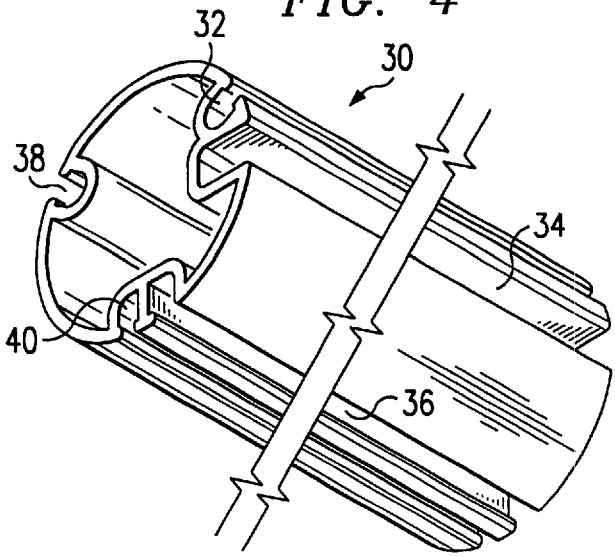
FIG. 4 is a perspective, broken view that illustrates a roller tube of the roller tube assembly.

FIG. 4 is a perspective, broken view that illustrates a roller tube 30 of the roller tube assembly 16, as previously illustrated. The roller tube 30 is, preferably, made of a metal, such as an extruded aluminum, and the various grooves, channels, or openings are provided longitudinally along the longitudinal axis of the roller tube 30. The roller tube 30 will generally span or closely define the width of the roller tube assembly 16 and may include a covering mounting groove 32, a rib storage groove 34, a light mounting groove 36, a valance mounting groove 38, and an auxiliary mounting groove 40.

The covering mounting groove 32 provides a cavity, housing, or mechanism for the roller tube 30 to grip or hold the front edge of the covering 14, as previously illustrated in FIGS. 1–3. The rib storage groove 34 is used to receive and house, either fully or partially, the plurality of retractable ribs 18. In an alternative embodiment, only one retractable 18 is provided in the roller tube 30. In a preferred embodiment, each of the plurality of retractable ribs 18 is provided with three segments that are connected end-to-end in a hinged arrangement such that each of the retractable ribs 18 may be retracted into a generally stacked arrangement and positioned or received within the rib storage groove 34. Depending on a particular application, either one or a plurality of retractable ribs 18 may be provided in the rib storage groove 34. The retractable ribs 18, similar to the roller tube 30, may be made of metal, such as extruded aluminum, or any other suitable material that provides the desired physical and mechanical characteristics. The retractable ribs 18 are illustrated and described more fully below.

The light mounting groove 36 provides a convenient, efficient, and safe location to position lights that run along the longitudinal axis of the roller tube 30. In a preferred embodiment, a string of lights encased within a clear plastic material, such as flexible PVC, is provided within and extending along the light mounting groove 36. The valance mounting groove 38 provides a convenient and efficient location and mechanism to grip the end or edge of the valance 26, as previously illustrated in FIGS. 1 and 2.

Finally, an auxiliary mounting groove 40 may also be included to provide additional flexibility to mount virtually anything a user desires. For example, the auxiliary mounting groove 40 may be used to grip the edge of a screen or other material that can then drape from the roller tube 30 to the ground or some intermediate location, similar to the valance 26 as illustrated in FIG. 1. Other applications for the auxiliary mounting groove 40 include the ability to hang objects, such as lights, mosquito repellants, bird feeders, and virtually any other device or object. In a preferred embodiment, auxiliary mounting groove 40 includes a piece of nylon ribbon, cord, or rope that may be wound up with the covering 14 when the retractable awning 10 is provided in a retracted position next to the structure 12. The ribbon, cord, or rope will preferably extend a foot or so below the roller tube 30 when the retractable awning 10 is in the retracted position. In this manner, the ribbon, cord, or rope provides a convenient mechanism to pull the roller tube assembly from the structure 12 from the retracted position to the extended or open position. Thus, the auxiliary mounting groove 40 provides added flexibility and may be used for a multitude of applications.

Although the various grooves and channels of the roller tube 30 have been described as, preferably, extending the entire longitudinal length of the roller tube 30, it should be understood that the various grooves and channels may in fact be of separate, discrete, or segmented lengths that do not span or extend the entire length of the roller tube 30. Of course, some or all of the various grooves may be present in any given application of the present invention.

Figure 5:
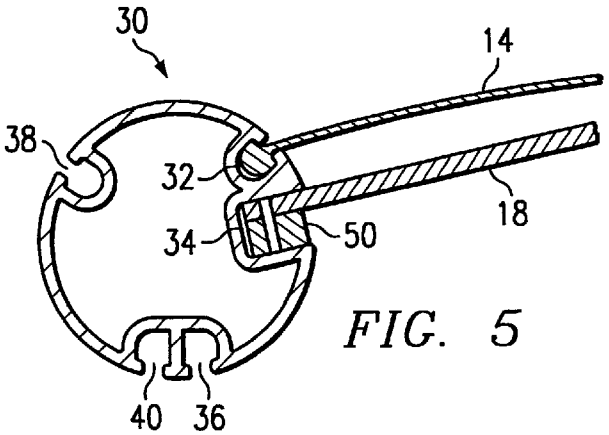
FIG. 5 is a side, cutaway view that illustrates the uses of various grooves of the roller tube when the retractable awning is in the extended position according to the preferred embodiment of the present invention.

FIG. 5 is a side, cutaway view that illustrates the uses of various grooves of the roller tube 30 when the retractable awning 10 is in the extended position according to the preferred embodiment of the present invention. The front edge of the covering 14 is shown engaged within the covering mounting groove 32 of the roller tube 30. The covering 14 will be supported through one or more of the retractable ribs 18 as the covering 14 begins to sag or droop between the roller tube 30 and the structure 12.

The retractable rib 18 featured in FIG. 5 is shown in the extended position. Only the segment of the retractable rib 18 that hingeably couples to the roller tube 30 within the rib storage groove 34 is shown. A spacer or mounting block 50 is also shown and is provided within the rib storage groove 34 to provide support to the end of the segment of the retractable rib 18 that, preferably, hingeably couples to the roller tube 30 through this arrangement. The thickness of the spacer or mounting block 50 will generally be provided at a distance that is about equal to the thickness of the remaining segments, such as two additional segments, of the retractable rib 18. The remaining grooves of the roller tube 30, that is the light mounting groove 36, the valance mounting groove 38 and the auxiliary mounting groove 40 are not illustrated as being used in FIG. 5.

Figure 6:
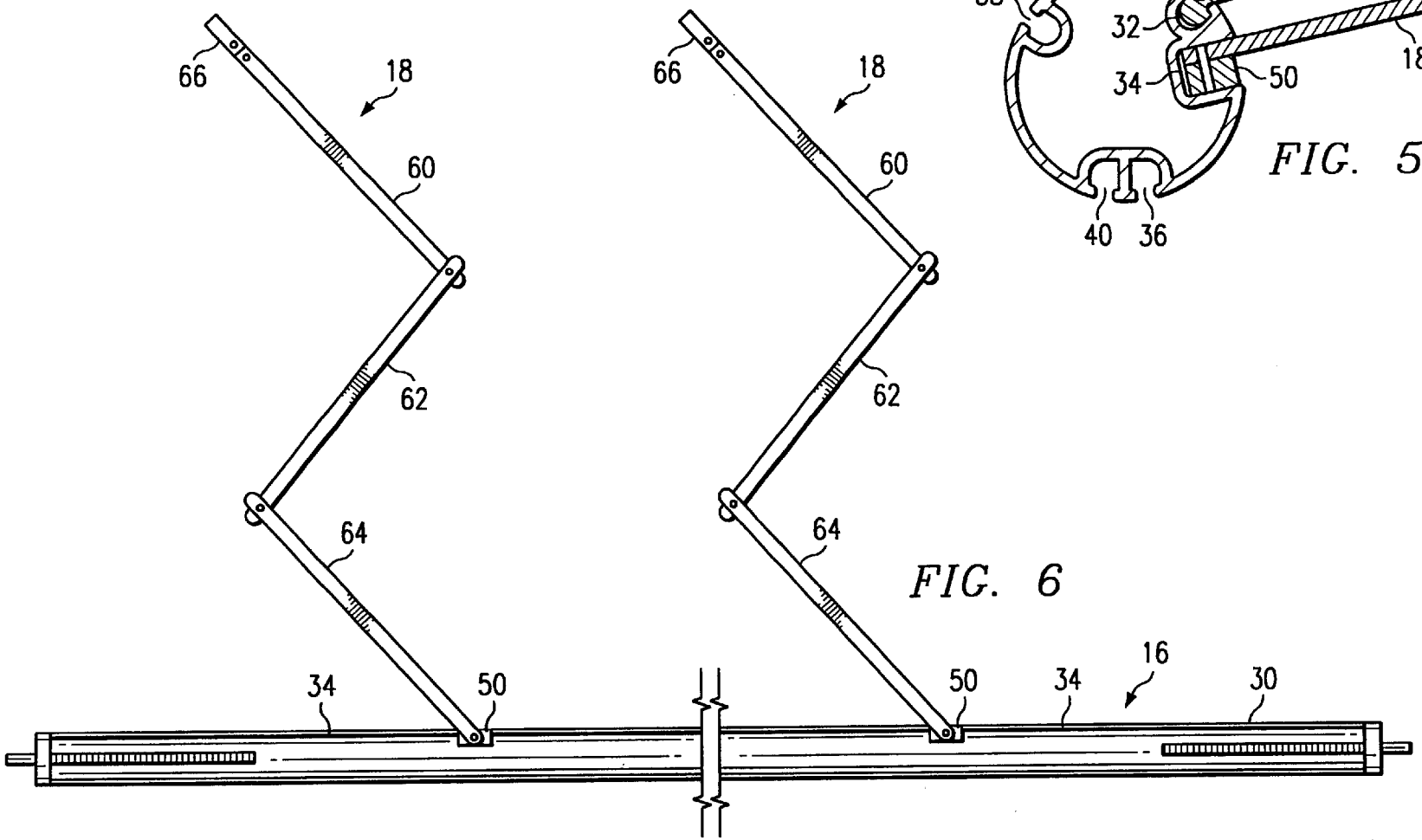
FIG. 6 is a top view of the roller tube assembly that illustrates the hinged couplings of two of the retractable ribs and the coupling of the retractable ribs to the rib storage groove of the roller tube.

FIG. 6 is a top view of the roller tube assembly 16 that illustrates the hinged couplings of two of the retractable ribs 18 and the coupling of the retractable ribs 18 to the rib storage groove 34 of the roller tube 30. FIG. 6 provides a cutaway view of the rib storage groove 34 around the spacer or mounting block 50 of the retractable ribs 18.

The retractable ribs 18 are illustrated with three segments. A first segment 60 hingeably couples to a second segment 62, which hingeably couples on its opposite end to a third segment 64. The far end of the first segment 60 may couple to an adjustable segment 66, which may simply be thought of as an adjustable or extendable end of the first segment 60. This adjustment may be made, in one embodiment, using a bolt and opening arrangement such that multiple openings or holes are provided in the first segment 60 to provide a means to adjust the ultimate length of the first segment 60 through the use of the adjustable segment or end 66. The end of the adjustable segment 66 may be covered by a rubber or plastic material or may have one or more sides of its end covered with a plastic or rubber material.

The retractable rib 18 couples to the roller tube 30 of the roller tube assembly 16 through a hinged coupling with the spacer or mounting block 50. The spacer or mounting block 50 is provided within the rib storage groove 34. Although the spacer or mounting block 50 is illustrated, any of a number of couplings may be used and would be readily apparent to one of ordinary skill in the art.

In other embodiments, the retractable ribs 18 may include various segments or pieces that are in a telescoping arrangement to one another such that the various segments may telescope in and out from one another, similar to a telescoping radio antenna. For example, the third segment 64 of the retractable rib 18 may be configured to allow the second segment 62 to telescope within it. Similarly, the first segment 60 may telescope within the second segment 62 and the first segment 64. This is only one example of another arrangement or configuration of a retractable rib that is contemplated and covered by the present invention.

Figure 7:
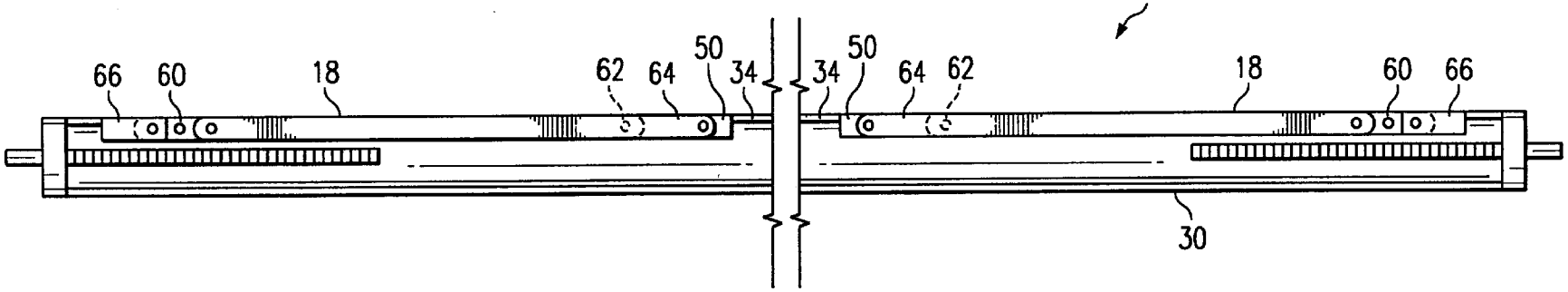
FIG. 7 is a top view, similar to FIG. 6, that illustrates the two retractable ribs positioned in the rib storage groove of the roller tube.
Figure 8:
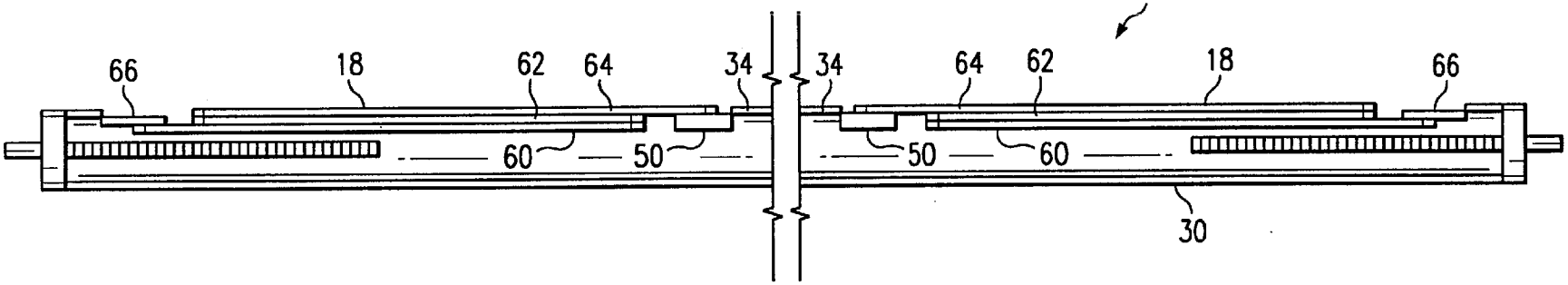
FIG. 8 is a rotated view of FIG. 7 that illustrates the two retractable ribs positioned in the rib mounting groove of the roller tube in a stacked arrangement when the retractable ribs are in a retracted position.

FIG. 7 is a top view, similar to FIG. 6, that illustrates the two retractable ribs 18 positioned in the rib storage groove 34 of the roller tube 30. It should be noted that FIG. 7 provides a cutaway view of portions of the rib storage groove 34 so that the stacked arrangement of the various segments of the retractable ribs 18 can be seen in a stacked relation to one another within the rib storage groove 34. FIG. 8 provides a view of the stacked arrangement of these retractable ribs 18 within the rib storage groove 34 if the retractable ribs 18 were rotated 90 degrees within the rib storage groove 34.

The two retractable ribs 18 of FIG. 6 are shown in FIG. 7 in their retracted or stored position within the rib storage groove 34. From this view, the third segment 64 is shown as the top segment and is shown hingeably coupled to the spacer or mounting block 50 on one of its ends. The other end of the third segment 64 is shown coupled to the second segment 62. The other end of the second segment 62 is shown by dashed or hidden lines as indicated by the reference numeral 62 next to these hidden lines. The hidden lines are provided because the second segment 62 is provided underneath the third segment 64. The hingeable coupling between the second segment 62 and the first segment 60 are also illustrated by the same hidden lines just discussed. The opposite end of the first segment 60 is shown attached to the adjustable segment 66.

In a preferred embodiment, the adjustable segment 66 is attached to the top of the first segment 60 such that the end of the first segment 60 is obscured by the adjustable segment 66. As is illustrated, the straight hidden line shown on the adjustable segment 66 illustrates this end of the third segment 64, which is coupled to the adjustable segment 66 through a hole in both the adjustable segment 66 and the third segment 64. This connection is illustrated by the solid dot in FIG. 7. As can be seen, the ability to retract the retractable ribs 18 and stack or arrange them in such a manner that they are retained completely within or partially within the rib storage groove 34 results in substantial convenience and efficiency when providing the retractable awning 10 in a retracted or stored position.

FIG. 8 is a rotated view of FIG. 7 that illustrates the two retractable ribs 18 positioned in the rib storage groove 34 of the roller tube 30 in a stacked arrangement when the retractable ribs 18 are in a retracted position. As mentioned above, FIG. 8 provides a view of the stacked arrangement of the retractable ribs 18 within the rib storage groove 34 if the retractable ribs 18 of FIG. 7 were rotated 90 degrees within the rib storage groove 34. Just as with FIG. 7, FIG. 8 provides a side cutaway view of the retractable ribs of FIG. 7.

One end of the third segment 64 of the retractable rib 18 is shown hingeably coupled to the spacer or mounting block 50. The other end of the third segment 64 is shown hingeably coupled to the second segment 62. The remaining end of the second segment 62 couples with one end of the first segment 60. As is illustrated, the various segments of the retractable ribs 18 reside in a stacked position within the rib storage groove 34.

The remaining end of the first segment 60 couples to the adjustable segment 66. The adjustable segment 66 resides on the top of the end of the first segment 60. This saves additional space and uses unused volume within the rib storage groove 34. The adjustable segment 66 may be moved outward or inward, depending on the desired length of the retractable rib 18.

Figure 9:
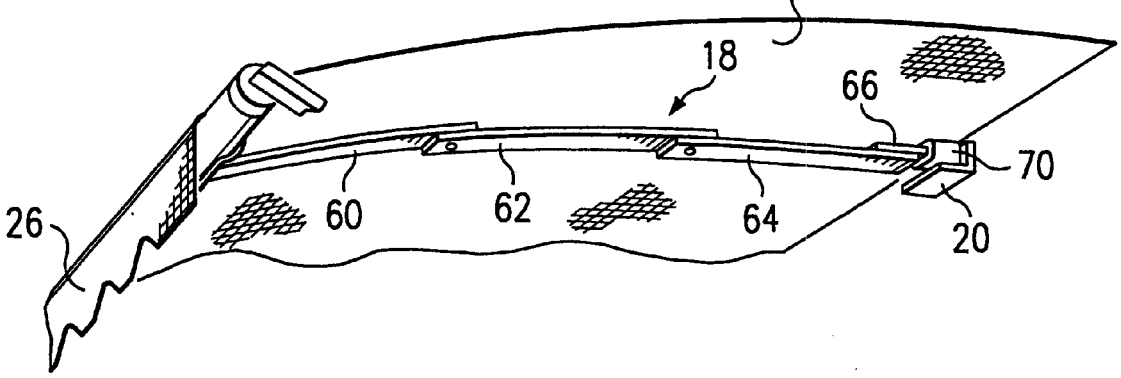
FIG. 9 is a partial, perspective view that illustrates one of the retractable ribs in an extended position and with a slight upward bow to support the covering.

FIG. 9 is a partial, perspective view that illustrates one of the retractable ribs 18 in an extended position and with a slight upward bow or arch to support the covering 14. The stacked arrangement of the three-segmented retractable rib 18 can also be seen. In one embodiment, the far end of the adjustable segment 66 is shown with a plastic or rubber tip 70 to protect the interface between the hanger 20 and the far end of the retractable rib 18. It should be understood that the hanger 20 may be provided in virtually any configuration and that the rubber tip 70 may be provided in any configuration. In another embodiment, the rubber tip is included as part of the hanger 20. In still other embodiments, the hanger 20 and the rubber tip 70 are not present. The thickness of the rubber tip 70 can present problems when the retractable rib 18 is retracted into the rib storage groove 34 of the roller tube 30. In one embodiment, this problem may be solved by only including rubber or protective material on the end of the adjustable segment 66 and on the top or bottom but not on both sides. This is illustrated more fully in other FIGS. 17 through 19.

The retractable rib 18 is also shown with a slight upward bend or bow to provide additional support to the covering 14. This provides significant advantages when water or other substances are contact the top of the covering 14. Instead of pooling on the top of the covering 14, these substances will be repelled off of the top of the covering 14.

Figure 10:
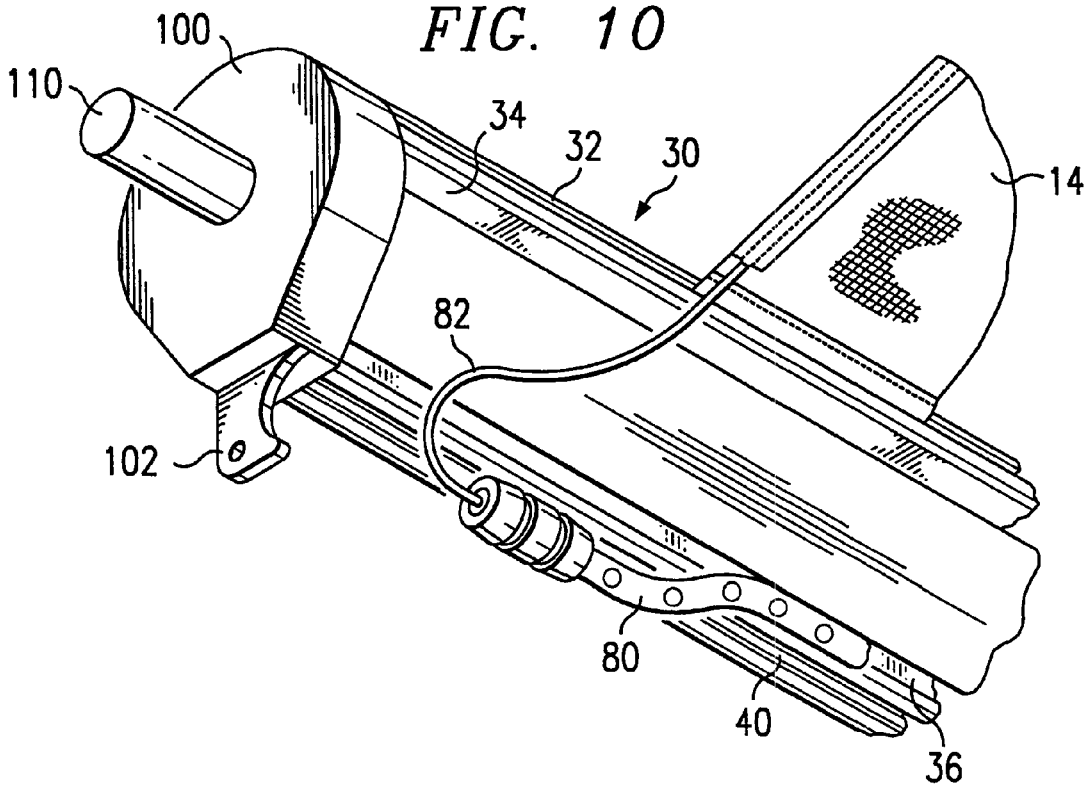
FIG. 10 is a perspective view that illustrates an interface between string lights positioned in a light mounting groove of the roller tube and an electrical conductor that supplies power to the string lights.

FIG. 10 is a perspective view that illustrates an interface between string lights 80 (also referred to as rope lighting) positioned in the light mounting groove 36 of the roller tube 30 and an electrical conductor 82 that supplies power to the string lights 80. The string lights 80 mount and are retained within the light mounting groove 36 of the roller tube 30. Also shown in FIG. 10 are several of the other grooves such as the auxiliary mounting groove 40 and the covering mounting groove 32, which is shown engaging the front edge of the covering 14 to retain the covering 14 when the retractable awning 10 is in an extended or open position. Electricity is provided to the string lights 80 through an electrical conductor 82. A connection, such as a plug-type connection is shown in FIG. 10. The electrical conductor 82 is provided, in a preferred embodiment, along one of the side edges of the covering 14. As is illustrated, the conductor 82 may be sewn into the side hem of the covering 14. In one embodiment, a slight excess of the electrical conductor 82 is provided so that when the covering 14 is rolled around the roller tube 30, the connector remains accessible.

In a preferred embodiment, the connector between the electrical conductor 82 and the string lights 80 is eliminated. Instead, the electrical conductor 82 is provided from the covering 14 through an opening or hole in the roller tube 30, such as through an opening or hole in the covering mounting groove 32, to provide access to the interior of the roller tube 30. The electrical conductor 82 is then provided through an opening or hole in the roller tube 30 to access the string lights 80. Preferably, this opening or hole is provided in the light mounting groove 36. In this manner, the electrical conductor 82 may interface directly with the string lights 80 and the external connector may be eliminated entirely. This arrangement also improves the appearance by eliminating the excess electrical conductor 82 and the associated connector.

An end cap 100 is shown mounted to one end of the roller tube 30. A ratchet key 102 is provided with or as a part of the end cap 100. An end cylinder 110 is also shown in FIG. 10. The functions and operations of these components are illustrated fully in FIG. 11 and described more fully below.

Figure 11:
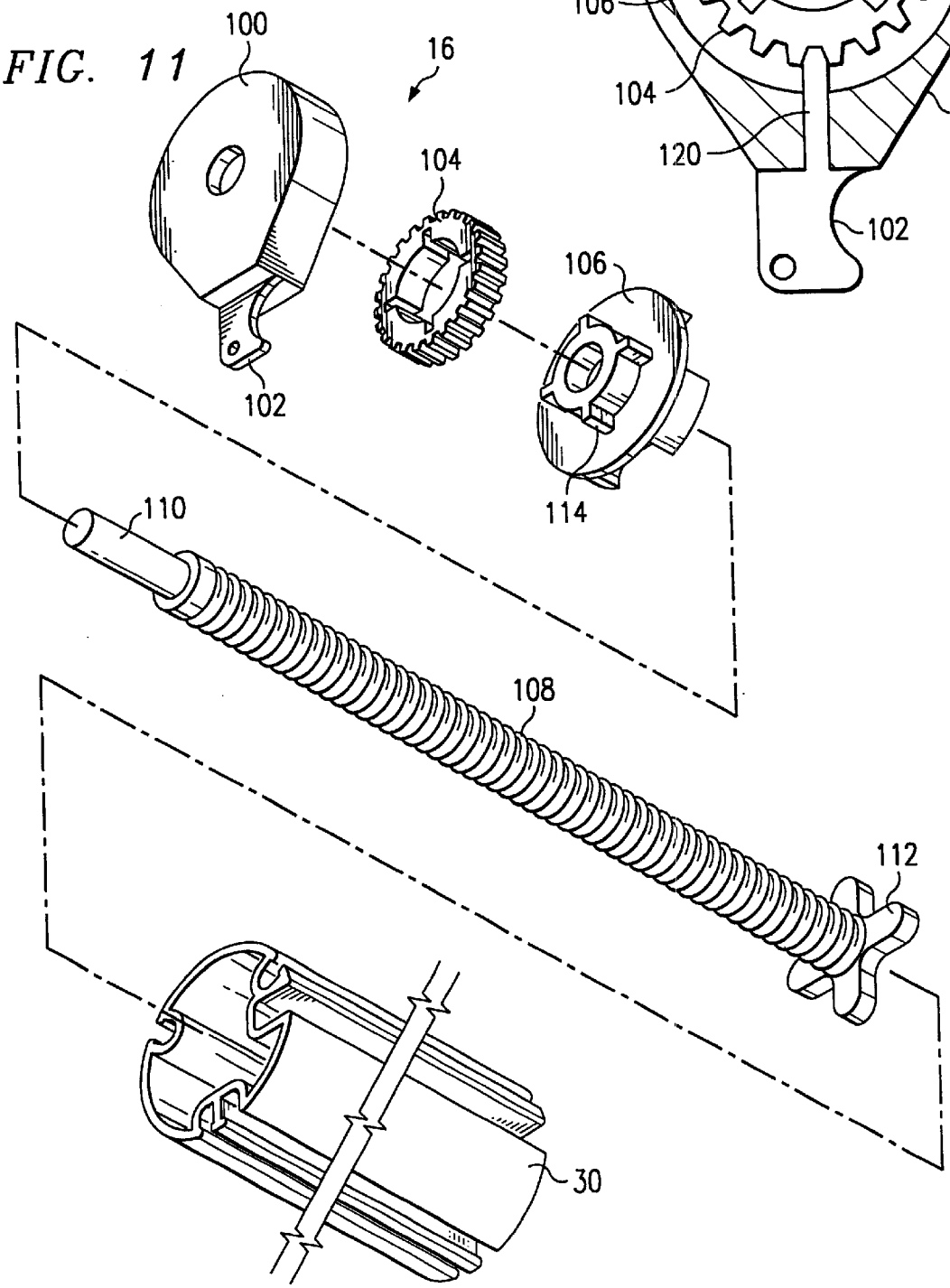
FIG. 11 is an exploded perspective view that illustrates the relationship of various components of the roller tube assembly.

FIG. 11 is an exploded perspective view that illustrates the relationship of various components of the roller tube assembly 16. The end cap 100, the ratchet key 102, a ratchet gear 104, and a base plate 106 may be referred to as a ratchet mechanism. The ratchet mechanism controls the storage and release of rotational energy provided by a ratchet spring assembly.

The ratchet spring assembly may include a torsion spring 108 mounted between an end cylinder 110 and a spring stay 112. The ratchet spring assembly fits or is positioned partially within the interior of the roller tube 30. The spring stay 112 is provided in a configuration or shape that uses the groove formations from within the roller tube 30 to prevent its rotation relative to the roller tube 30.

When assembled, the end cylinder 110 is positioned through the center of the base plate 106, the ratchet gear 104 and the end cap 100. In one embodiment, the base plate 106 is attached to the roller tube 30 with rivets. The center opening of the base plate 106 receives the end cylinder 110, and a key member 114 of the base plate 106 lockingly engages the interior portion of the ratchet gear 104. The ratchet key 102, which is illustrated more fully in FIG. 12, includes a key mechanism that allows the ratchet gear 104 to rotate in one direction only. The ratchet key 102 may be rotated 180 degrees so that the rotation of ratchet gear 104, if desired, may be in the opposite direction.

Two ratchet spring assemblies will, preferably, be provided within the roller tube 30. These may be referred to as a right hand ratchet spring assembly and a left hand ratchet spring assembly such that each end of the roller tube 30 will include an end cylinder of the ratchet spring assembly extending from an end cap 100. This provides equal torque on both sides of the roller tube assembly 16. This is especially important when the roller tube assembly 16 is longer.

In operation, when the retractable awning 10 is moved from its retracted or stored position to an extended or open position, the torsion spring 108 turns, with the roller tube assembly 16, to store rotational or potential energy. The ratchet mechanism, including the ratchet key 102, prevents the torsion spring 108 from releasing its energy. The rotational energy of the torsion spring 108 may then be released through the removal of the ratchet key 102. The ratchet key 102 and the ratchet gear 104 operate, similar to a winch, to provide a locking mechanism to store the potential energy of the torsion spring 108. In other embodiments, the storing and releasing of energy may be reversed. In still other embodiments, a single spring stay 112 may be provided with a torsion spring 108 provided on either side of it.

Figure 12:
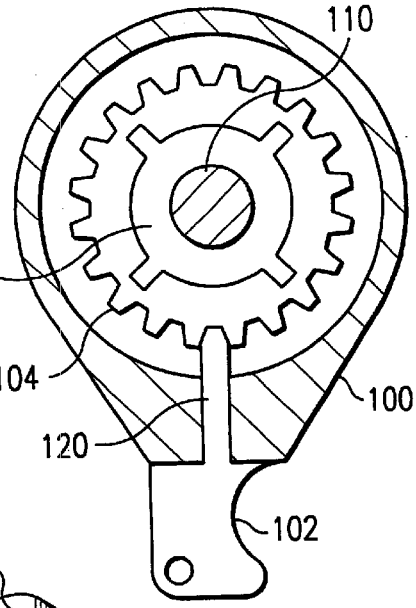
FIG. 12 is a side cutaway view that illustrates the ratchet mechanism.

FIG. 12 is a side cutaway view that illustrates the ratchet mechanism that includes the end cap 100, the ratchet key 102, the ratchet gear 104 and the base plate 106. The end cylinder 110 is shown provided through the center of the base plate 106, the ratchet gear 104, and the end cap 100.

As the roller tube 30 rotates to roll out the covering 14 from a stored or retracted position to an open or extended position, the ratchet gear 104 rotate in a clockwise direction, in the embodiment shown in FIG. 12, along with the base plate 106. The orientation of a lever 120 of the ratchet key 102 allows the various outer gears of the ratchet gear 104 to rotate in a clockwise direction. This allows potential or rotational energy to be stored in the torsion spring 108. At some later time when the retractable awning 10 is being transitioned from the open or extended position to a stored or retracted position, the ratchet key 102, along with the lever 120, will be rotated 180 degrees such that the end of the lever 120 that engages the external gears of the ratchet gear 104 will allow the stored energy in the torsion spring 108 to release its rotational energy. This allows the covering 14 to be wound around the roller tube 30 for storage.

FIG. 13 is a perspective view that illustrates a retractable awning 300 in an extended position according to another embodiment of the present invention. The covering 304, usually made of fabric or other supple material, is attached to the roller tube assembly 306 along one edge and a wall 302 of a structure along the opposite edge. The roller tube assembly 306 is supported at either end by a right and a left arm/side rafter support (or support arms), which latch onto or couple with the side of the wall 302, forming a generally triangular shape as viewed from the front end of the vehicle. The arm/side rafter supports include an arm 322 and a side rafter 324. Both of these members are retractable. When not in use, the arm/side rafter supports are collapsed and latched vertically to the side wall 302 of the vehicle, as the covering 314 is wrapped around the roller tube assembly 306 and latched to the top edge of the wall 302 or roof of the vehicle for storage.

A plurality of hinged ribs 310 (also referred to as retractable ribs) are shown in their extended position, and in a slightly bowed or arched position to support the covering 314 from below.

FIG. 14 is a cutaway, exploded perspective view that illustrates an alternative retractable rib, hinged rib 310. The rib 310 includes a first outer bar 312 and a second inner bar 314, substantially equal in length, joined together to form a rib 310 by a center pivot pin 318 hinging the second bar 314 to the first bar 312. The center pivot pin 318 may have any construction known in the art, provided that the pin 318 is removable or adjustable in order to permit adjustment in the length of the rib 310.

The center pivot pin 318 may be of the binding post type, having a first, externally threaded section and a second, internally threaded barrel section 320 adapted to receive the threaded section. As shown in FIG. 14, at least one of the bars has a plurality of longitudinally spaced holes 330 defined therein. The overall length of the rib 310 may be adjusted by removing the center pivot pin 318, aligning a hole 332 defined in the inner bar 314 with one of the plurality of holes 330 defined in the outer bar 312 and installing the center pivot pin 318.

The outer bar 312 is pivotally attached to a footing 26 at the end opposite its junction with the inner bar 314. The footing 326 is a channel or U-shaped fitting which receives the end of the outer bar 312. It should be understood that the footing 326 may be provided in virtually any configuration. In other embodiments, the footing 326 may not be included. The inner bar 314 has a tip or cap 328 on the end opposite its junction with the outer bar 312. The cap 328 may be a rubber cap having a high coefficient of friction which is separately molded and placed over the end of the inner bar 314, or it may be a plastic cap formed by dipping the end of the inner bar 314 into a liquid plastic of the type which solidifies when exposed to air. A cross section of the cap 328 shown attached to the end of the inner bar 314 is shown in FIG. 17.

In one embodiment, the outer bar 312 and the inner bar 314 are made from aluminum, but in alternative embodiments, they may be made from a thermoplastic material. A typical dimension for the bars 312 and 314 might be one inch by one-quarter inch. The bars 312 and 314 are substantially flat. The length of each bar is selected so that the overall length of the rib 310 is slightly greater than the distance from the wall 302 of the structure to the roller tube assembly 306, each bar 312 and 314 typically being about four feet. The bars 312 and 314 are flexible enough to be bowed or arched by a compressive force, but resilient enough to be restored to their original shape with the compressive force removed.

Figure 15:
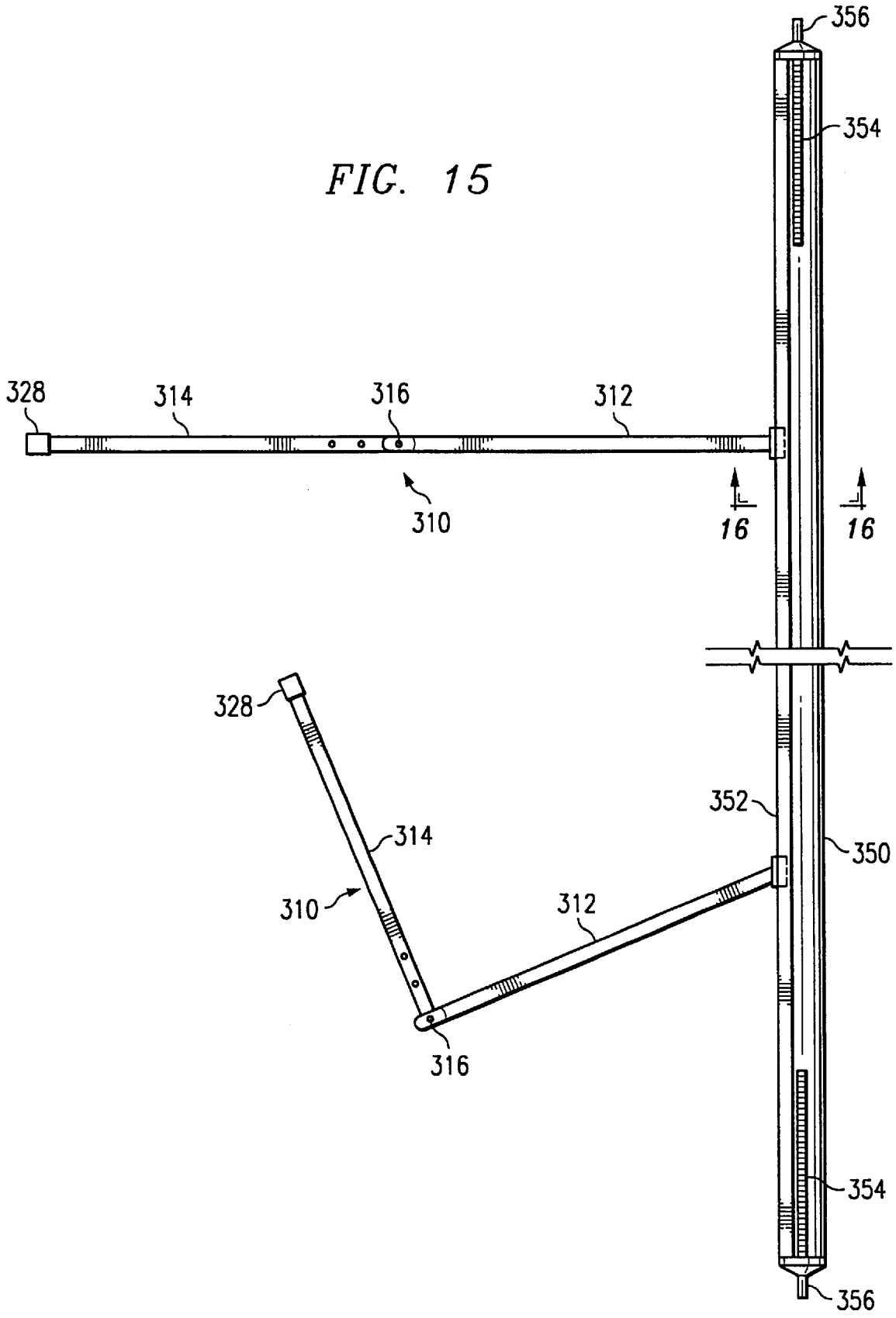
FIG. 15 is a top view of another roller tube assembly that illustrates the hinged couplings of two of the retractable ribs and the coupling of the retractable ribs to the rib storage groove of the roller tube according to an alternative embodiment of the present invention.

FIG. 15 is a top view of another roller tube assembly 350 that illustrates the hinged couplings of two of the retractable or hinged ribs 310 and the coupling of the retractable or hinged ribs 310 to a channel 352 (also referred to as the rib storage groove) of the roller tube according to an alternative embodiment of the present invention. A plurality of hinged ribs 310 may be disposed in a channel 352 defined in the roller tube assembly 350.

The roller tube of the roller tube assembly 350 has roller shade type spring assemblies 354 disposed internally and a latching mechanism 356 at one or both ends, as are well known and conventional in the art. The latching mechanism 356 operates to lock the springs 354 and prevent further wrapping or unwrapping of the covering 304 about the roller tube assembly 350 when locked, and to release the springs 354 when unlocked.

One method of attaching the hinged ribs 310 to the roller tube assembly 350 is shown more particularly in FIG. 16. The channel 352, in the embodiment shown, extends longitudinally for the entire length of the roller tube assembly 350, and extends radially towards the center of the roller tube assembly 350 immediately adjacent to the point of attachment of the covering 304 to the roller tube assembly 350. During manufacture the footing 326 may be inserted into the channel 352 and slid along the length of the tube 50 to its desired location and fixedly attached to the tube 50 by conventional means, as by screws through the footing 326 into the bottom of the channel 352 at either side of the end of the outer bar 312. After the ribs 310 are installed, an end cap (not shown) may be placed over the end of the roller tube 50. The channel 352 and footing 326 are wide enough to accommodate the outer bar 312 and inner bar 314 resting adjacent to one another.

In use, the hinged ribs 310 are stored in the channel 352 of the roller tube 50. The covering 304 is extended by unlatching the roller tube of the roller tube assembly 350 and arm/side rafter supports (also referred to as support arms) and unwrapping the covering 304 in the usual manner. With the covering 304 extended, the hinged rib 310 is extended to its full length by pivoting the outer bar 312 on footing 326 and pivoting the inner bar 314 around the hinge formed by the center pivot pin 318. The end of the rib 310 terminating with cap 328 may be supported on the wall 302 by any conventional means, as by friction between the wall 302 and a rubber cap 328.

In one embodiment, the end of the inner bar 314 terminating with cap 328 is supported by a hanger bracket 358 attached to the top of the wall 302. The hangar bracket 358 may be an aluminum angle which may typically have dimensions of about ¾" by ¾" by three inches. One hanger bracket 358 is attached to the wall 302 opposite the footing 326 of each rib 310 in such a manner that each rib 310 extends perpendicularly to both the roller tube of the roller tube assembly 50 and the wall 302.

Since the length of each rib 310 is slightly greater than the distance between the tube 50 and the wall 302, the rib 310 must be slightly bowed or arched by pressing upward at the center of the rib 310. The length of the rib 310 may be adjusted, if necessary, by removing the center pivot pin 318 and realigning the holes 330 and 332. The radius of curvature of the rib 310 may be further adjusted by unlocking the latching mechanism 356 on the roller tube, rolling the covering 304 towards the wall 302, and re-locking the latching mechanism 356.

After use, the rib 310 is removed from the hangar bracket 358 and collapsed or folded by pivoting the inner bar 314 so that it is adjacent and contiguous to the outer bar 312 for substantially their entire length, and then pivoted around the footing to lie disposed within the channel 352 when retracted. The roller tube of the roller tube assembly 350 may vary in length. For example, they may be provided with a length of sixteen to twenty feet, approximately three to four hinged ribs 310 may be disposed between the tube of the roller tube assembly 350 and the wall 302 to ensure adequate stretching and support of the covering 304.

FIG. 16 is a side, section view along the line 16—16 of FIG. 15 that illustrates the use of the rib storage groove or the channel 352 and the covering 304 of a covering mounting groove of the roller tube of roller tube assembly 350 when the retractable awning is in the extended position according to an alternative embodiment of the present invention. The footing 326 is shown within the channel 352 and in a hinged or center pivot relation with one end of the outer bar 312. The outer bar 312 is shown with a slight upward arch used to support the covering 304. Additional room can be seen within the channel 352 to provide an area for the inner bar 314 to retract, in a stacked arrangement, within the channel 352.

FIG. 17 is a partial, side, section view along the line 17—17 of FIG. 14 that illustrates the tip or cap 328 of the inner bar 314 of the rib 310. The cap 328 may be made of virtually any material, such as rubber, plastic, or a polymer. The embodiment of the cap 328 covers the top, bottom, and end of the tip of inner bar 314. This arrangement of cap 328 allows for the rib 310 to be positioned more fully within the channel 352 when the rib 310 is retracted while also providing a cushion or protective end to the tip or end of the inner bar 314.

FIG. 18 is a partial, perspective view that illustrates the tip or cap 328 of the inner bar 314 of the retractable or hinged rib 310 of FIG. 17. As can be seen, this embodiment of the cap 328 covers the top, bottom, and end of the tip of inner bar 314, and not the sides. In other embodiments, all sides of the tip of inner bar 314 are covered or, for example, the two sides and the end of the tip of inner bar 314 are covered. This arrangement may assist with the rib 310 being positioned within the channel 352 in another dimension.

FIG. 19 is a partial, side, cutaway view that illustrates the interface of the cap 328 of the inner bar 314 of the rib 310 and a hanger 358, according to one embodiment of the present invention. As discussed previously, the hanger 358 may be provided in any convenient configuration, such as, for example, the hanger 358 of FIG. 20.

FIG. 20 is a partial, side, cutaway view that illustrates the interface of the cap 328 of the inner bar 314 of the retractable or hinged rib 310 and another hanger 358. This may be referred to as a cutaway rib socket that receives and holds the rib 310 at the tip or end of the inner bar 314.

FIG. 21 is a front view that illustrates an alternative hanger 358 with a protective socket layer to receive and hold the rib 310 at the tip or end of the inner bar 314. The protective socket eliminates the need for cap 328 by providing a protective or cushioned interior portion to receive the end of the bar 314 away from the roller tube assembly 350. The hanger 358 may couple to a structure, such as a wall 302.

Thus, it is apparent that there has been provided, in accordance with the present invention, a retractable awning and method that provides an awning with retractable ribs or support members that can be easily, conveniently, and quickly setup and assembled and taken down without the need to separately store the retractable ribs, and that satisfies one or more of the advantages set forth above. Although the preferred embodiment has been described in detail, it should be understood that various changes, substitutions, and alterations can be made herein without departing from the scope of the present invention, even if all of the advantages identified above are not present. For example, the retractable awning may include one or more retractable ribs that each have one or more segments. In fact, the number of segments of each retractable rib may vary from multiple retractable ribs of the same retractable awning. For example, one retractable rib may include three segments and another may include four segments.

The present invention may be implemented using any of a variety of materials and configurations. For example, and as mentioned above, in other embodiments, the retractable ribs may include various segments or pieces that are in a telescoping arrangement to one another such that the various segments may telescope in and out from one another, similar to a telescoping radio antenna. This is only one example of another arrangement or configuration of a retractable rib that is contemplated and covered by the present invention. The various components, members, elements, and methods described and illustrated in the preferred embodiment as discrete or separate may be combined or integrated with other components, members, elements, and methods without departing from the scope of the present invention. The retractable awning of the present invention may be mounted or used in connection with virtually any available structure including, without limitation, buildings, sheds, carports, garages, homes, walls, vehicles, such as recreational vehicles, trailers, mobile homes, manufactured homes, greenhouses, porches, patios, decks, and the like. Other examples of changes, substitutions, and alterations are readily ascertainable by one skilled in the art and could be made without departing from the spirit and scope of the present invention.

What is claimed is:

1. A retractable awning operable to mount to a structure, the retractable awning comprising:

a flexible string light;

a roller tube assembly that includes a roller tube having a first end, a second end, an outer surface between the first and second ends, and a light mounting groove operable to receive the flexible string light, a portion of the outer surface defining an opening communicating with the light mounting groove, the opening configured to receive at least a portion of the flexible string light through the opening for placement in the light mounting groove;

a covering operable to couple to the structure and the roller tube assembly;

an electrical conductor permanently coupled to provide an electrical path to the flexible string light, the electrical conductor at least partially retained by the covering and communicating with the light mounting groove within the roller tube via an inner area within roller tube;

a first support arm coupled to the first end of the roller tube and the support; and a second support arm coupled to the second end of the roller tube and the support.

2. A roller tube assembly for use in a retractable awning, the roller tube assembly comprising:

a flexible string light;

a roller tube having a first end, a second end, an outer surface between the first and second ends, and a light mounting groove operable to receive the flexible string light, a portion of the outer surface defining an opening configured to receive at least a portion of the flexible string light through the opening for placement in the light mounting groove; and an electrical conductor communicating with the light mounting groove within the roller tube via an inner area within roller tube.

3. A retractable awning, which may be mounted to a structure, the retractable awning comprising:

a roller tube assembly that includes:

a roller tube having a first end, a second end, a rib storage groove to receive a retractable rib, and a light mounting groove to receive a string light, and a retractable rib coupled with the roller tube and extendable from a retracted position, at least partially within the rib storage groove, to an extended position;

a covering positioned around the roller tube assembly;

a first support arm coupled to the first end of the roller tube and the support; and a second support arm coupled to the second end of the roller tube and the support.

4. The retractable awning of claim 3, wherein the covering includes an electrical conductor to couple with the string light.

5. A roller tube assembly for use in a retractable awning, the roller tube assembly comprising:

a roller tube having a first end, a second end, a rib storage groove to receive a retractable rib, and a light mounting groove to receive a string light; and a retractable rib coupled with the roller tube and extendable from a retracted position, at least partially within the rib storage groove, to an extended position.

6. A retractable awning, which may be mounted to a structure, the retractable awning comprising:

a flexible string light;

a roller tube assembly that includes a roller tube having a first end, a second end, an outer surface between the first and second ends, and a light mounting groove to receive the flexible string light, a portion of the outer surface defining an opening communicating with the light mounting groove, the opening configured to receive at least a portion of the flexible string light through the opening for placement in the light mounting groove;

a covering positioned around the roller tube assembly;

an electrical conductor to provide an electrical path to the string light;

a first support arm coupled to the first end of the roller tube and the support; and a second support arm coupled to the second end of the roller tube and the support.

7. A roller tube assembly for use in a retractable awning, the roller tube assembly comprising:

a flexible string light; and a roller tube having a first end, a second end, an outer surface between the first and second ends, and a light mounting groove to receive the flexible string light, a portion of the outer surface defining an opening communicating with the light mounting groove, the opening configured to receive at least a portion of the flexible string light through the opening for placement in the light mounting groove.

8. A retractable awning operable to mount to a structure, the retractable awning comprising:

a roller tube assembly that includes:

a roller tube having a first end, a second end, a light mounting groove operable to receive a string light, and a rib storage groove operable to receive a retractable rib, and a retractable rib operable to couple with the roller tube and to extend from a retracted position, at least partially within the rib storage groove, to an extended position;

a covering operable to couple to the structure and the roller tube assembly;

a first support arm coupled to the first end of the roller tube and the support; and a second support arm coupled to the second end of the roller tube and the support.

9. The retractable awning of claim 8, wherein the covering includes an electrical conductor operable to couple with the string light.

10. A roller tube assembly for use in a retractable awning, the roller tube assembly comprising:

a roller tube having a first end, a second end, a light mounting groove operable to receive a string light, and a rib storage groove operable to receive a retractable rib; and a retractable rib operable to couple with the roller tube and to extend from a retracted position, at least partially within the rib storage groove, to an extended position.

* * * * *